US008790494B2

(12) United States Patent
Swerin et al.

(10) Patent No.: US 8,790,494 B2
(45) **Date of Patent: *Jul. 29, 2014**

(54) PAPER WITH IMPROVED STIFFNESS AND BULK AND METHOD FOR MAKING SAME

(71) Applicants: Agne Swerin, Bandhagen (SE); Jay C. Song, Highland Mills, NY (US); Ladislav Bednarik, Loveland, OH (US); Peter F. Lee, Auckland (NZ); Michael C. Herman, Monroe, NY (US); Sen Yang, Highland Mills, NY (US)

(72) Inventors: Agne Swerin, Bandhagen (SE); Jay C. Song, Highland Mills, NY (US); Ladislav Bednarik, Loveland, OH (US); Peter F. Lee, Auckland (NZ); Michael C. Herman, Monroe, NY (US); Sen Yang, Highland Mills, NY (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/906,864

(22) Filed: May 31, 2013

(65) Prior Publication Data

US 2013/0255897 A1 Oct. 3, 2013

Related U.S. Application Data

(63) Continuation of application No. 12/215,686, filed on Jun. 27, 2008, now Pat. No. 8,460,512, which is a continuation of application No. 10/662,699, filed on Sep. 15, 2003, now abandoned.

(60) Provisional application No. 60/410,666, filed on Sep. 13, 2002.

(51) Int. Cl.

| | |
|---|---|
| ***D21H 17/63*** | (2006.01) |
| ***D21H 21/22*** | (2006.01) |
| ***D21H 21/16*** | (2006.01) |
| ***D21H 21/54*** | (2006.01) |
| ***D21H 23/22*** | (2006.01) |

(52) U.S. Cl.

USPC ..... 162/175; 162/123; 162/135; 162/158; 162/168.1; 162/168.3; 162/181.1; 162/181.2; 162/184; 162/185; 162/181.8; 106/206.1; 106/208.1; 106/211.1; 106/215.1; 106/217.9; 428/402; 428/402.22; 428/532

(58) Field of Classification Search

USPC ..... 162/123, 125, 135, 158, 175, 164.1, 162/169, 168.1–168.2, 181.1–181.8, 162/183–185; 106/162.1, 206.1, 208.1, 106/208.3, 211.1, 215.1, 217.9; 428/532–534, 537.5, 402–402.22

See application file for complete search history.

(56) References Cited

U.S. PATENT DOCUMENTS

| | | | | |
|---|---|---|---|---|
| 1,117,113 | A | | 11/1914 | Wagg |
| 1,892,873 | A | | 1/1933 | Darrah |
| 1,500,207 | A | | 7/1942 | Shaw |
| 2,800,458 | A | | 7/1957 | Green |
| 3,200,033 | A | | 8/1965 | Grossteinbeck et al. |
| 3,293,114 | A | * | 12/1966 | Kenaga et al. ..... 162/168.7 |
| 3,357,322 | A | | 12/1967 | Gill |
| 3,359,130 | A | | 12/1967 | Goldman |
| 3,468,467 | A | | 9/1969 | Amberg |
| 3,515,569 | A | | 6/1970 | Walters et al. |
| 3,533,908 | A | | 10/1970 | Hoogsteen |
| 3,546,060 | A | | 12/1970 | Hoppe et al. |
| 3,556,497 | A | | 1/1971 | Grenfell |
| 3,556,934 | A | | 1/1971 | Meyer |
| 3,611,583 | A | | 10/1971 | Anderson et al. |
| 3,615,972 | A | | 10/1971 | Morehouse |
| 3,626,045 | A | | 12/1971 | Woodings |
| 3,703,394 | A | | 11/1972 | Hemming et al. |
| 3,740,359 | A | | 6/1973 | Garner |
| 3,779,951 | A | | 12/1973 | Streu |
| 3,785,254 | A | | 1/1974 | Mann |
| 3,819,463 | A | | 6/1974 | Ervin et al. |
| 3,819,470 | A | | 6/1974 | Shaw et al. |
| 3,824,114 | A | | 7/1974 | Vassiliades et al. |
| 3,842,020 | A | | 10/1974 | Garrett |
| 3,864,181 | A | | 2/1975 | Wolinski et al. |
| 3,878,038 | A | | 4/1975 | Opderbeck et al. |
| 3,914,360 | A | | 10/1975 | Gunderman et al. |

(Continued)

FOREIGN PATENT DOCUMENTS

| | | |
|---|---|---|
| CN | 1417390 | 5/2003 |
| CN | 101392473 | 3/2009 |

(Continued)

OTHER PUBLICATIONS

"Density of starch granules—Potato *Solanum tuberosum*—BNID 103206",Bionumbers—the database of useful biological numbers, Milo et al. Nucl. Acids Res. (2010) 38 (suppl 1): D750-D753, [online], Retrieved from the Internet, [retrieved on Jul. 21, 2013] <URL: http://bionumbers.hms.harvard.edu/bionumber.aspx?s=y&id=103206&ver=7>.*

(Continued)

*Primary Examiner* — Dennis Cordray

(74) *Attorney, Agent, or Firm* — Thomas W. Barnes, III; Eric W. Guttag

(57) ABSTRACT

The invention provides a three layered reprographic paper having improved strength, stiffness and curl resistance properties, and a method for making same. The paper has a central core layer made largely of cellulose and bulked with a bulking agent such as a diamide salt. A starch-based metered size press coating is pressed on both sides of the core layer, wherein the starch has a high solid content. The coating forms a three layered paper having an I-beam arrangement with high strength outer layers surrounding a low density core.

23 Claims, 2 Drawing Sheets

(56) References Cited

U.S. PATENT DOCUMENTS 3,936,890 A 2/1976 Oberstein
3,941,634 A 3/1976 Nisser
3,945,956 A 3/1976 Garner
3,998,618 A 12/1976 Kreick et al.
4,002,586 A 1/1977 Wessling et al.
4,006,273 A 2/1977 Wolinski et al.
4,022,965 A 5/1977 Goheen et al.
4,040,900 A 8/1977 Mazzarella et al.
4,044,176 A 8/1977 Wolinski et al.
4,051,277 A 9/1977 Wilkinson et al.
4,056,501 A 11/1977 Gibbs et al.
4,075,136 A 2/1978 Schaper
4,108,806 A 8/1978 Cohrs et al.
4,133,688 A 1/1979 Sack
4,166,894 A 9/1979 Schaper
4,174,417 A 11/1979 Rydell
4,179,546 A 12/1979 Garner et al.
4,233,325 A 11/1980 Slangan et al.
4,237,171 A 12/1980 Laage et al.
4,241,125 A 12/1980 Canning et al.
4,242,411 A 12/1980 Costa, Jr. et al.
4,243,480 A 1/1981 Hernandez et al.
4,268,615 A 5/1981 Yonezawa
4,279,794 A 7/1981 Dumas
4,323,602 A 4/1982 Parker
4,324,753 A 4/1982 Gill
4,344,787 A 8/1982 Beggs et al.
4,385,961 A 5/1983 Svending et al.
4,431,481 A 2/1984 Drach et al.
4,435,344 A 3/1984 Iioka
4,448,638 A 5/1984 Klowak
4,451,585 A 5/1984 Andersson
4,464,224 A 8/1984 Matolcsy
4,477,518 A 10/1984 Cremona et al.
4,482,429 A 11/1984 Klowak
4,483,889 A 11/1984 Andersson
4,496,427 A 1/1985 Davison
4,548,349 A 10/1985 Tunberg
4,581,285 A 4/1986 Mahefkey, Jr.
4,617,223 A 10/1986 Hiscock et al.
4,619,734 A 10/1986 Andersson
4,722,943 A 2/1988 Melber et al.
4,777,930 A 10/1988 Hartz
4,781,243 A 11/1988 DeVogel et al.
4,829,094 A 5/1989 Melber et al.
4,836,400 A 6/1989 Chaffey et al.
4,865,875 A 9/1989 Kellerman
4,885,203 A 12/1989 Wakat
4,898,752 A 2/1990 Cavagna et al.
4,902,722 A 2/1990 Melber
4,946,737 A 8/1990 Lindeman et al.
4,952,628 A 8/1990 Blatz
4,959,395 A 9/1990 Janda
4,977,004 A 12/1990 Bettle, III et al.
4,982,722 A 1/1991 Wyatt
4,986,882 A 1/1991 Mackey et al.
4,988,478 A 1/1991 Held
5,000,788 A * 3/1991 Stotler ..... 106/211.1
5,029,749 A 7/1991 Aloisi
5,049,235 A 9/1991 Barcus et al.
5,092,485 A 3/1992 Lee
5,096,650 A 3/1992 Renna
5,101,600 A 4/1992 Morris et al.
5,102,948 A 4/1992 Deguchi et al.
5,125,996 A 6/1992 Campbell et al.
5,126,192 A 6/1992 Chellis et al.
5,132,061 A 7/1992 Lindeman et al.
5,139,538 A 8/1992 Morris et al.
5,145,107 A 9/1992 Silver et al.
5,155,138 A 10/1992 Lundqvist
5,160,789 A 11/1992 Barcus et al.
5,209,953 A 5/1993 Grupe et al.
5,219,875 A 6/1993 Sherba et al.
5,225,123 A 7/1993 Torobin
5,226,585 A 7/1993 Varano
5,242,545 A 9/1993 Bradway et al.
5,244,541 A 9/1993 Minton
5,266,250 A 11/1993 Kroyer
5,271,766 A 12/1993 Koutlakis et al.
5,296,024 A 3/1994 Hutcheson
5,342,649 A 8/1994 Sarokin
5,360,420 A 11/1994 Cook et al.
5,360,825 A 11/1994 Noguchi et al.
5,363,982 A 11/1994 Sadlier
5,370,814 A 12/1994 Salyer
5,397,759 A 3/1995 Torobin
5,417,753 A 5/1995 Hutcheson
5,424,519 A 6/1995 Salee
5,443,899 A 8/1995 Barcus et al.
5,454,471 A 10/1995 Norvell
5,464,622 A 11/1995 Mehta et al.
5,477,917 A 12/1995 Salyer
5,478,988 A 12/1995 Hughes et al.
5,484,815 A 1/1996 Petersen et al.
5,490,631 A 2/1996 Iioka et al.
5,499,460 A 3/1996 Bryant et al.
5,514,429 A 5/1996 Kamihgaraguchi et al.
5,520,103 A 5/1996 Zielinski et al.
5,531,728 A 7/1996 Lash
5,536,756 A 7/1996 Kida et al.
5,585,119 A 12/1996 Petersen et al.
5,593,680 A 1/1997 Bara et al.
5,601,744 A 2/1997 Baldwin
5,629,364 A 5/1997 Malmbom et al.
5,637,389 A 6/1997 Colvin et al.
5,649,478 A 7/1997 Chadha
5,662,761 A 9/1997 Middelman et al.
5,662,773 A 9/1997 Frederick et al.
5,667,637 A 9/1997 Jewell et al.
5,674,590 A 10/1997 Anderson et al.
5,685,068 A 11/1997 Bankestrom et al.
5,698,074 A 12/1997 Barcus et al.
5,698,688 A 12/1997 Smith et al.
5,700,560 A 12/1997 Kotani et al.
H1704 H 1/1998 Wallajapet et al.
5,705,242 A 1/1998 Andersen et al.
5,731,080 A 3/1998 Cousin et al.
5,759,624 A 6/1998 Neale et al.
5,785,817 A 7/1998 Tan et al.
5,792,398 A 8/1998 Andersson
5,800,676 A 9/1998 Koike et al.
5,856,389 A 1/1999 Kostrzewski et al.
5,861,214 A 1/1999 Kitano et al.
5,880,435 A 3/1999 Bostic
5,884,006 A 3/1999 Frohlich et al.
5,938,825 A 8/1999 Gaglani et al.
5,952,068 A 9/1999 Neale et al.
5,965,109 A 10/1999 Lohrmann
6,007,320 A 12/1999 Froese et al.
6,034,081 A 3/2000 Whittemore et al.
6,042,936 A 3/2000 Kempf
6,133,170 A 10/2000 Suenaga et al.
6,134,952 A 10/2000 Garver et al.
6,146,494 A 11/2000 Seger et al.
6,225,361 B1 5/2001 Nakajima
6,228,200 B1 5/2001 Willis et al.
6,235,394 B1 5/2001 Shimazawa et al.
6,248,799 B1 6/2001 Peretti et al.
6,254,725 B1 7/2001 Lau et al.
6,267,837 B1 7/2001 Mitchell et al.
6,308,883 B1 10/2001 Schmelzer et al.
6,352,183 B1 3/2002 Kristiansen et al.
6,361,651 B1 3/2002 Sun
6,379,497 B1 * 4/2002 Sandstrom et al. ..... 162/123
6,387,492 B2 5/2002 Soane et al.
6,391,154 B1 5/2002 Nyg.ang.rd et al.
6,391,943 B2 5/2002 Sarma et al.
6,406,592 B2 6/2002 Leskela et al.
6,454,989 B1 9/2002 Neely et al.
6,455,156 B1 9/2002 Tanaka et al.
6,471,824 B1 10/2002 Jewell
6,497,790 B2 12/2002 Mohan et al.
6,506,282 B2 1/2003 Hu et al.
6,509,384 B2 1/2003 Kron et al.

(56) References Cited

U.S. PATENT DOCUMENTS

| | | | | |
|---|---|---|---|---|
| 6,531,183 | B1 | 3/2003 | Cason et al. | |
| 6,537,680 | B1 | 3/2003 | Norlander et al. | |
| 6,579,414 | B2 | 6/2003 | Jewell | |
| 6,579,415 | B2 | 6/2003 | Jewell | |
| 6,582,557 | B2 | 6/2003 | Jewell | |
| 6,582,633 | B2 | 6/2003 | Elfving et al. | |
| 6,592,712 | B2 | 7/2003 | Koukoulas et al. | |
| 6,592,717 | B2 | 7/2003 | Jewell | |
| 6,592,983 | B1 | 7/2003 | Carson et al. | |
| 6,613,810 | B1 | 9/2003 | Ejiri et al. | |
| 6,617,364 | B2 | 9/2003 | Soane et al. | |
| 6,630,232 | B1 | 10/2003 | Muser et al. | |
| 6,701,637 | B2 | 3/2004 | Lindsay et al. | |
| 6,740,373 | B1 | 5/2004 | Swoboda et al. | |
| 6,802,938 | B2 | 10/2004 | Mohan et al. | |
| 6,846,529 | B2 | 1/2005 | Mohan et al. | |
| 6,864,297 | B2 | 3/2005 | Nutt et al. | |
| 6,866,906 | B2 | 3/2005 | Williams et al. | |
| 6,890,636 | B2 | 5/2005 | Danver | |
| 6,893,473 | B2 | 5/2005 | Neogi et al. | |
| 6,919,111 | B2 | 7/2005 | Swoboda et al. | |
| 6,984,347 | B2 | 1/2006 | Masuda et al. | |
| 7,018,509 | B2 | 3/2006 | Kilgannon et al. | |
| 7,033,527 | B2 | 4/2006 | Kim et al. | |
| 7,070,679 | B2 | 7/2006 | Cason et al. | |
| 7,192,989 | B2 | 3/2007 | Svedberg et al. | |
| 7,202,284 | B1 | 4/2007 | Limerkens et al. | |
| 7,230,036 | B2 | 6/2007 | Glorioso, Jr. et al. | |
| 7,232,607 | B2 | 6/2007 | Satake et al. | |
| 7,252,882 | B2 | 8/2007 | Satake et al. | |
| 7,253,217 | B2 | 8/2007 | Sohal | |
| 7,291,239 | B2 | 11/2007 | Polanco et al. | |
| 7,335,279 | B2 | 2/2008 | Mohan et al. | |
| 7,361,399 | B2 | 4/2008 | Song et al. | |
| 7,482,046 | B2 | 1/2009 | Williams et al. | |
| 7,682,486 | B2 | 3/2010 | Mohan et al. | |
| 7,740,740 | B2 | 6/2010 | Mohan et al. | |
| 7,790,251 | B2 | 9/2010 | Williams et al. | |
| 7,943,011 | B2 | 5/2011 | Reed et al. | |
| 8,030,365 | B2 | 10/2011 | Mohan et al. | |
| 8,034,847 | B2 | 10/2011 | Mohan et al. | |
| 8,460,512 | B2 * | 6/2013 | Swerin et al. | 162/175 |
| 2001/0024716 | A1 | 9/2001 | Chen et al. | |
| 2001/0038893 | A1 | 11/2001 | Mohan et al. | |
| 2001/0044477 | A1 | 11/2001 | Soane et al. | |
| 2001/0046574 | A1 | 11/2001 | Curtis | |
| 2002/0074100 | A1 | 6/2002 | Yeh et al. | |
| 2002/0096277 | A1 | 7/2002 | Lau et al. | |
| 2002/0104632 | A1 | 8/2002 | Jimenez et al. | |
| 2002/0148832 | A1 | 10/2002 | Breining et al. | |
| 2002/0152630 | A1 | 10/2002 | Lindsay et al. | |
| 2003/0003268 | A1 | 1/2003 | Williams et al. | |
| 2003/0008931 | A1 | 1/2003 | Soane et al. | |
| 2003/0008932 | A1 | 1/2003 | Soane et al. | |
| 2003/0065041 | A1 | 4/2003 | Keiser et al. | |
| 2003/0152724 | A1 * | 8/2003 | Swoboda et al. | 428/34.2 |
| 2003/0175497 | A1 | 9/2003 | Kobe et al. | |
| 2003/0213544 | A1 | 11/2003 | Hesch | |
| 2004/0030080 | A1 | 2/2004 | Chang et al. | |
| 2004/0052989 | A1 | 3/2004 | Mohan et al. | |
| 2004/0065423 | A1 | 4/2004 | Swerin et al. | |
| 2004/0065424 | A1 | 4/2004 | Mohan et al. | |
| 2004/0099391 | A1 | 5/2004 | Ching et al. | |
| 2004/0123966 | A1 | 7/2004 | Altman et al. | |
| 2004/0157057 | A1 | 8/2004 | Tasaki et al. | |
| 2004/0170836 | A1 | 9/2004 | Bond et al. | |
| 2004/0181053 | A1 * | 9/2004 | Bruun et al. | 536/45 |
| 2004/0197500 | A9 | 10/2004 | Swoboda et al. | |
| 2004/0209023 | A1 | 10/2004 | Swoboda et al. | |
| 2004/0221976 | A1 | 11/2004 | Williams et al. | |
| 2004/0238138 | A1 | 12/2004 | Ishizaki et al. | |
| 2004/0249005 | A1 | 12/2004 | Kron et al. | |
| 2005/0031851 | A1 | 2/2005 | Depres | |
| 2005/0079352 | A1 | 4/2005 | Glorioso et al. | |
| 2005/0098286 | A1 | 5/2005 | Williams et al. | |
| 2005/0112305 | A1 | 5/2005 | Swoboda et al. | |
| 2005/0133183 | A1 | 6/2005 | Mohan et al. | |
| 2005/0221073 | A1 | 10/2005 | Liou | |
| 2006/0000569 | A1 | 1/2006 | Kron et al. | |
| 2006/0057356 | A1 | 3/2006 | Yamamura et al. | |
| 2006/0057365 | A1 | 3/2006 | Swoboda et al. | |
| 2006/0060317 | A1 | 3/2006 | Roding et al. | |
| 2006/0063000 | A1 | 3/2006 | Tokumura et al. | |
| 2006/0099247 | A1 | 5/2006 | Cantwell et al. | |
| 2006/0102307 | A1 | 5/2006 | Kron et al. | |
| 2006/0131362 | A1 | 6/2006 | Bergenudd et al. | |
| 2006/0173087 | A1 | 8/2006 | Hyde et al. | |
| 2006/0185808 | A1 | 8/2006 | Nguyen | |
| 2006/0207735 | A1 | 9/2006 | Blanz et al. | |
| 2006/0231227 | A1 | 10/2006 | Williams et al. | |
| 2006/0235095 | A1 | 10/2006 | Leberfinger et al. | |
| 2006/0235096 | A1 | 10/2006 | Luisi | |
| 2007/0043130 | A1 | 2/2007 | Svedberg et al. | |
| 2007/0044929 | A1 | 3/2007 | Mohan et al. | |
| 2007/0142485 | A1 | 6/2007 | Nordin et al. | |
| 2007/0154711 | A1 | 7/2007 | Masuda et al. | |
| 2007/0208093 | A1 | 9/2007 | Nordin et al. | |
| 2007/0256805 | A1 | 11/2007 | Reed et al. | |
| 2007/0287776 | A1 | 12/2007 | Nordin et al. | |
| 2008/0017338 | A1 | 1/2008 | Nordin et al. | |
| 2008/0163992 | A1 | 7/2008 | Mohan et al. | |
| 2008/0171186 | A1 | 7/2008 | Mohan et al. | |
| 2008/0314539 | A1 | 12/2008 | Williams et al. | |
| 2009/0020247 | A1 | 1/2009 | Swerin et al. | |
| 2009/0246459 | A1 | 10/2009 | Williams et al. | |
| 2009/0280328 | A1 | 11/2009 | Masuda et al. | |
| 2010/0032114 | A1 | 2/2010 | Mohan et al. | |
| 2010/0032115 | A1 | 2/2010 | Mohan et al. | |
| 2010/0051220 | A1 | 3/2010 | Hong et al. | |
| 2010/0252216 | A1 | 10/2010 | Mohan et al. | |
| 2011/0036526 | A1 | 2/2011 | Williams et al. | |
| 2011/0277949 | A1 | 11/2011 | Mohan et al. | |
| 2013/0040121 | A1 | 2/2013 | Singh | |
| 2013/0146240 | A1 | 6/2013 | Mohan et al. | |
| 2013/0146241 | A1 | 6/2013 | Hong et al. | |

FOREIGN PATENT DOCUMENTS

| | | | |
|---|---|---|---|
| EP | 0031161 | A1 | 12/1980 |
| EP | 102335 | | 3/1984 |
| EP | 0056219 | | 3/1985 |
| EP | 0049672 | | 4/1985 |
| EP | 0041054 | | 10/1985 |
| EP | 112807 | | 11/1987 |
| EP | 320473 | | 6/1989 |
| EP | 0190788 | | 4/1990 |
| EP | 0432355 | | 6/1991 |
| EP | 0629741 | | 6/1994 |
| EP | 0596750 | | 9/1994 |
| EP | 0666368 | | 2/1995 |
| EP | 0700237 | | 3/1996 |
| EP | 0651696 | | 8/1998 |
| EP | 0751866 | | 4/1999 |
| EP | 1050622 | | 11/2000 |
| EP | 1101809 | | 5/2001 |
| EP | 0484893 | | 6/2001 |
| EP | 1531198 | | 5/2005 |
| EP | 1275688 | | 12/2005 |
| EP | 1712585 | | 10/2006 |
| EP | 1852552 | | 11/2007 |
| GB | 0786543 | | 11/1957 |
| GB | 0903416 | | 8/1962 |
| GB | 1311556 | | 3/1973 |
| GB | 1373788 | | 11/1974 |
| GB | 1401675 | | 7/1975 |
| GB | 1412857 | | 11/1975 |
| GB | 1533434 | | 11/1978 |
| JP | 55023126 | | 2/1980 |
| JP | 56030439 | | 3/1981 |
| JP | 59227933 | | 12/1984 |
| JP | 2056240 | | 2/1990 |
| JP | 4059674 | | 2/1992 |
| JP | 06157215 | | 6/1994 |
| JP | 06329834 | | 11/1994 |

(56) References Cited

FOREIGN PATENT DOCUMENTS

| | | |
|---|---|---|
| JP | 10219596 | 8/1998 |
| JP | 11209504 | 8/1999 |
| JP | 2000273235 | 10/2000 |
| JP | 2005001357 | 1/2005 |
| JP | 2005179685 | 7/2005 |
| JP | 2006063509 | 3/2006 |
| WO | 8806916 | 9/1988 |
| WO | 9222191 | 12/1992 |
| WO | 9323614 | 11/1993 |
| WO | 9423952 | 10/1994 |
| WO | 9520479 | 8/1995 |
| WO | 9526441 | 10/1995 |
| WO | WO 03/018638 A1 * | 3/2003 |

OTHER PUBLICATIONS

"Starch Slurry Density", International Starch Institute, [online], 1999-2012, Retrieved from the Internet, [retrieved on Jul. 21, 2013] <URL: http://www.starch.dk/isi/tables/density.asp>.*

Smook, Gary A., Handbook for Pulp and Paper Technologists, 2nd ed, Angus Wilde Publications, 1992, pp. 220, 283-285 and 292.*

J. Peel, Paper Science & Paper Manufacture 1999, pp. 18-19.*

Lipponen et al, "Novel method for quantitative starch penetration analysis through iodine staining and image analysis of cross-sections of uncoated fine paper", Nordic Pulp and Paper Research Journal, vol. 19, pp. 300-308, 2004.*

Smook, Gary A., Handbook for Pulp and Paper Technologists, 2nd ed, Angus Wilde Publications, 1992, pp. 220, 285 and 292-295.

Akzo Nobel Expancel 551 DE 20 Dry Expanded Microspheres, Material Data Sheet from MatWeb.com.

Moulton, Glen E. "Chemical Reactions: Ionic, Covalent, and Polar Covalent Bonds." The Complete Idiot's Guide to Biology 2004. Penguin Group.

Tappi/May 1972, vol. 55, No. 5, p. 770-771.

Tappi/Dec. 1973, vol. 56, No. 12, p. 158-160.

"The Use of Microspheres to Improve Paper Properties", by Soderberg, Paper Technology, Aug. 1989, pp. VIII/17-VII/21.

"The Application of Microspheres for the Production of High Bulk Papers", by M. Baumeister, Das Papier, vol. 26, No. 10A: 716-720 (1972).

"Microspheres find use as fiber replacement in low-density board", by David O. Bowen, Pulp Paper Nov. 1976, p. 126-127, 1972.

"Foams on the Cutting Edge", by Ray Erikson, Jan. 1999.

"Xpancel.RTM.", An Introduction, a publication from Expancel, Box 13000, S0-850 13 Sundsvall, Sweden.

Expancel .RTM. Expandable Microspheres in Paper and Board, by Mark Lunabba, KemaNord Plast AB, Sector Microspheres, Box 13000, S-850 13 Sundsvall, Sweden.

"Expandable Microspheres in Board", World Pulp Paper Technology, pp. 143-145.

E. Strazdins in the Sizing of Paper, Second Edition, cited by W. F. Reynolds, TAPPI Press, 1989, pp. 1-31.

Sindall, R. W., "Paper Technology. An Elementary Manual on the Manufacture, Physical Qualities and Chemical Constituents of Paper and Paper-Making Fibres," 1906, Charles Griffin and Company, limited, pp. 1-5.

C.E. Farley and R.B. Wasser in the Sizing of Paper, Second Edition, edited by W. F. Reynolds, TAPPI Press, 1989, pp. 51.62.

R. Wessling, Science and Technology of Polymer Colloids, NATO ASI Series E: Applied Sciences, No. 68, p. 393-421 (1983).

Maf Ahmad, Thermoplastic Microspheres As Foaming Agents for Wood Plastic Comp, Presented at WPC 2004 Conference, Vienna, Austria (http://www.expancel.com/english/bulletin/flles/WPC2004PaperMA2.pdf) p. 1-13.

Yasuhiro Kawaguchi et al.., Synthesis and properties of thermoplastic expandable microspheres: The relation between crosslinking density and expandable property, Journal of Applied Polymer Science, vol. 93, Issue 2, pp. 505-512, (2004).

Samel et al., Expandable microspheres incorporated in a PDMS matrix: a novel thermal composite actuator for liquid handling in microfluidic applications, TRANSDUCERS, Solid-State Sensors, Actuators and Microsystems, 12th International Conference, vol. 2, Issue 8-12, Jun. 2003, pp. 1558-1561.

Hollow Microsperes, Chemical Engineering Technology, vol. 27, issue 8, pp. 829-837, Published Online: Aug. 2, 2004.

* cited by examiner

PAPER WITH IMPROVED STIFFNESS AND BULK AND METHOD FOR MAKING SAME

This application is a CON of U.S. application Ser. No. 12/215,686, filed Jun. 27, 2008, now U.S. Pat. No. 8,460,512, which is a CON of U.S. application Ser. No. 10/662,699, filed Sep. 15, 2003, ABANDONED, and which claims the benefit of U.S. Provisional Application No. 60/410,666, filed Sep. 13, 2002.

FIELD OF THE INVENTION

The invention relates to the papermaking arts and, in particular, to the manufacture of paper substrates. This invention also relates to articles manufactured from the substrates of this invention such as printing paper and paperboard articles.

BACKGROUND OF THE INVENTION

The contemporary work and home offices use a multitude of paper products including, but not limited to reprographic paper grades, and paperboard, such as writing papers, printing paper, copy paper, and forms paper. Unfortunately, such paper and paperboard products exhibit one or more disadvantages. For example, some of these products have relatively low basis weights or are not sufficiently stiff in bending or durable to sustain a full run through a copy machine. Thus, within the industry there is a constant aim to produce reprographic papers at lower basis weights, but at equal stiffness properties, in order to save raw materials and to be able to increase productivity. Other important properties of reprographic papers are curl, i.e. out-of-plane movement, and hygroexpansivity, i.e. expansion and contraction of the paper with varying relative humidities. A low curl is required during stacking of paper in copier machines and for correct feeding. A low hygroexpansivity is required because curl is a function of the hygroexpansivity, and of the material distribution in the sheet (see e.g. Carlsson, L.: A Study of the Bending Properties of Paper and their Relation to the Layered Structure, Doctoral thesis, Chalmers University of Technology, Department of Polymeric Materials, Gothenburg, Sweden, 1980, ISBN 91-7032-003-9). The hygroexpansivity and curl are also a function of the papermaking process, especially during drying of a fibrous web (see e.g. Handbook of Physical Testing of Paper, $2^{nd}$ Edition, Vol. I, Chapter 3, page 115-117, ISBN 0-8247-0498-3 by T. Uesaka: Dimensional Stability and Environmental Effects on Paper Properties). The bending stiffness $S_b$ of paper is a function of the elastic modulus E and the thickness t, such that $S_b$ is proportional to $Et^3$. This means that the most effective means to increase the bending stiffness is by increasing the paper thickness. However, the thickness normally must be retained within specifications. An even more efficient way to increase bending stiffness is to create an I-beam effect, i.e. strong dense outer layers and a lower density core. Mathematical expressions of a three-layered structure show that the I-beam effect creates considerably higher bending stiffness compared to a homogeneous structure if all other parameters are kept constant (see e.g. Handbook of Physical Testing of Paper, $2^{nd}$ Edition, Vol. 1, Chapter 5, page 233-256, ISBN 0-8247-0498-3 by C. Fellers and L. A. Carlsson: Bending Stiffness, with Special Reference to Paperboard). This knowledge has been reduced to practice in multiply paperboard as well as for low basis weight printing papers, such as reprographic papers (see e.g. Häggblom-Ahnger, U., 1998, Three-ply office paper, Doctoral thesis, Åbo Akademi University, Turku, Finland, 1998).

Modern size-press units of paper machines produce reprographic paper grades commonly having metered size-presses. These units enable the application of size-press starch (and/or other strengthening components) to other layers of the sheet. This technology has been demonstrated in the published literature (see e.g. Lipponen, J. et al.: Surface Sizing with Starch Solutions at High Solids Contents, 2002 Tappi Metered Size Press Forum, Orlando, Fla., May 1-4, 2002, Tappi Press 2002, ISBN 1-930657-91-9). The authors concluded a significant bending stiffness improvement running the starch solution at the size-press at 18% solids compared to lower solids (8, 12 and 15%).

There are also flooded-nip (also called pond or puddle) size-press units in common use. In this instance the potential for application of starch solutions to the outer layers is not the same as for metered size-press units due to inherent deeper penetration into the sheet in the flooded-nip. However, results in the literature suggest that an increase in starch solids can also cause less penetration with potential for improved bending stiffness (see e.g. Bergh, N.-O.: Surface Treatment on Paper with Starch from the Viewpoint of Production Increase, XXI EUCEPA International Conference, Vol. 2, Conferencias nos. 23 a 43, Torremolinos, Spain, page 547-, 1984). There is, however, room for considerable improvement in bending stiffness over the results reported in the literature and to receive other benefits such as stated above.

Accordingly there exists a need for improved paper and paperboard products that reduce or eliminate one or more of these disadvantages while being able to produce paperboard and reprographic, paper grades at considerably lower basis weights, at higher production rates, and, consequently, at lower manufacturing costs. Such an improvement would benefit from increased bulk of the paper web before the size-press application (n.b. the large influence of paper thickness on bending stiffness) in combination with high solids starch solutions including viscosity modifiers and/or crosslinkers to increase the strength of the size-press coating and to increase hold-out attachment of the surface to the applied layer. Further, it is the object of this invention to provide these benefits within a single-ply paper, thereby eliminating the costs associated with the additional machinery required for paper having multiple cellulosic layers.

SUMMARY OF THE INVENTION

Accordingly, it is an object of this invention to provide a paper or paperboard having improved bulk and stiffness having a three layered single-ply I-beam structure with a top layer, a central layer and a bottom layer, wherein the central layer is a cellulosic core layer, and the top and bottom layers are starch based, size-press applied coating layers that cover an upper and lower surface of the central layer with minimal penetration into the central layer, and a bulking agent interpenetrated within the cellulosic core layer.

It is a further object of the invention to provide a paper or paperboard having improved bulk and stiffness having a three layered single-ply I-beam structure having a top layer, a central layer and a bottom layer, wherein the central layer is a cellulosic core layer, and the top and bottom layers are starch based, size-press applied coating layers that cover an upper and lower surface of the central layer, the top and bottom layer have starch coat weights in the range of 2-10 gram per square meter, and a bulking agent interpenetrated within the cellulosic core layer.

It is an additional object of the invention to provide a method for making a paper or paperboard comprising the steps of providing a furnish including cellulosic fibers and a bulking agent, forming a fibrous web from the papermaking furnish, drying the fibrous web to form a dried web, size-press treating the dried web with a high strength starch based size-press solution to form top and bottom coating layers on a top and bottom side of the fibrous web, and drying the fibrous web after the size-press treatment to form a three layered single-ply having an I-beam structure.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/DRAWINGS

DETAILED DESCRIPTION

Figure 1:
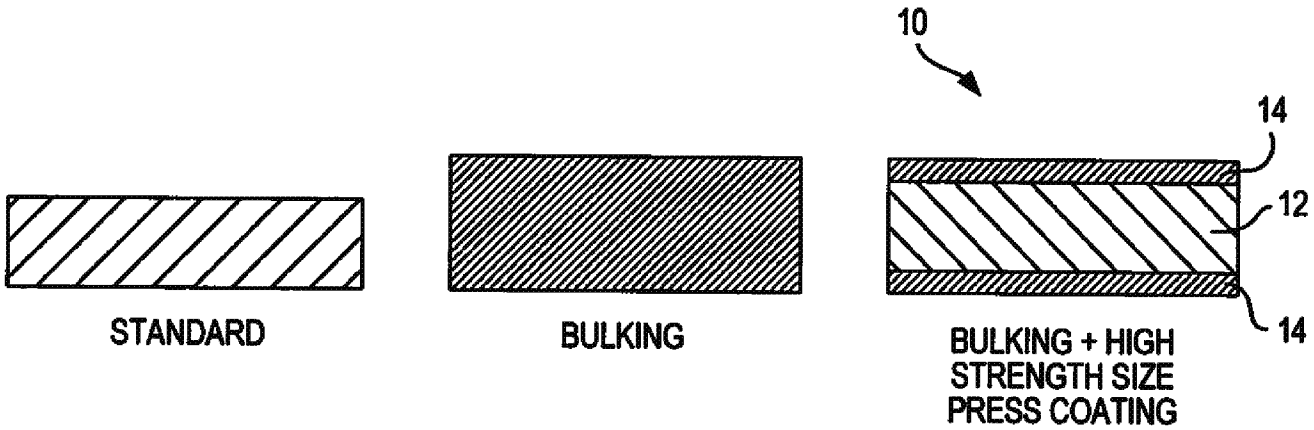
FIG. 1 is a schematic illustration of the three layered paper of the invention, achieved by bulking the base sheet and using high solids starch including viscosity modifiers/fillers/cross-linkers.

A paper 10 in accordance with one embodiment of the invention is shown in FIG. 1, wherein the term "paper", as used herein, includes not only paper and the production thereof, but also other web-like products, such as board and paperboard and the production thereof. A flat, bulked cellulosic core layer 12 is coated on both sides by a high strength starch based size-press coating 14. The cellulosic fibers are formed from a chemical pulp furnish having a mixture of hardwood and softwood fibers with additional fillers such as precipitated calcium carbonate or other fillers known in the art. The fibers may also be interspersed with surfactants, retention agents or other additives typically added to paper products. The precise ratio of softwood to hardwood fibers can vary within the scope of the invention. Ideally, the ratio of hardwood to softwood fibers varies between 3:1 and 10:1. However, other hardwood/softwood ratios or other types of fibers can be used, such as fibers from chemical pulp such as sulphate, and sulphite pulps, wood-containing or mechanical pulp such as thermomechanical pulp, chemo-thermomechanical pulp, refiner pulp and groundwood pulp. The fibers can also be based on recycled fibers, optionally from de-inked pulps, and mixtures thereof.

Cellulosic core layer 12 is a low density core bulked up by a bulking agent, thus achieving increased thickness. The preferred embodiment uses a diamide salt based hulking agent such as mono- and distearamides of animoethylethalonalamine, commercially known as Reactopaque 100, (Omnova Solutions Inc., Performance Chemicals, 1476 J. A. Cochran By-Pass, Chester, S.C. 29706, USA and marketed and sold by Ondeo Nalco Co., with headquarters at Ondeo Nalco Center, Naperville, Ill. 60563, USA) in about 0.025 to about 0.25 wt % by weight dry basis. However, various chemical bulking agents known in art can be used, such as quaternized imidazoline or microspheres, wherein the microspheres are made from a polymeric material selected from the group consisting of methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Core layer 12 may contain other materials, such as surfactants, retention agents and fillers known in the art. The use of retention agents are generally preferred if microspheres are utilized as the bulking agent. In the preferred embodiment utilizing diamide salt, no retention agents are required.

In the preferred embodiment, starch based coating layers 14 cover both surfaces of the core layer. The high density coatings cover an upper and lower surface of the lower density bulked cellulose core, creating an I-beam effect that is a three-layered single-ply paper product. In other embodiments, only one side of the cellulosic core layer may be coated with a starch size press coating. The high strength coatings are formed from starch based solutions in a solids range of 6-20%, but preferably more starch strength than a typical paper yet low enough to prevent excessive penetration of the coatings into the core layers. Commercial embodiments of the present invention generally use solid content of about 6-12%. However, in other preferred embodiments, high stiffness can be achieved with starch solids of about 18%.

The coating penetrates the cellulose core layer minimally or not at all. As a result, starch can be substantially absent from the cellulose core. The control of the penetration is ideally achieved with a metered size press coating, such that the thickness of the outer film can be closely monitored. In preferred embodiments, the ratio of the film thicknesses of the starch coating layers to the paper as a whole is between 1:50 and 1:1.1. The porosity levels of the paper also effects coating penetration. Controlling the thickness and penetration is key to create three separate adjacent layers that form the I-beam structure having high strength outer coatings around a lower density core.

The starches used in the coating can be any starch typically used in a coating, preferably a hydroxy ethylated starch, oxidized starch, cationically modified or enzymatically converted starch from any regularly used starch source, such as from potato, corn, wheat, rice or tapioca. The coating may further contain viscosity modifiers, cross-linkers and pigments such as polyvinyl alcohols, ammonium zirconium carbonate, borate chemicals, glyoxal, melamine formaldehyde, ground and precipitated calcium carbonates, clays, talc, $TiO_2$, and silica.

Figure 2:
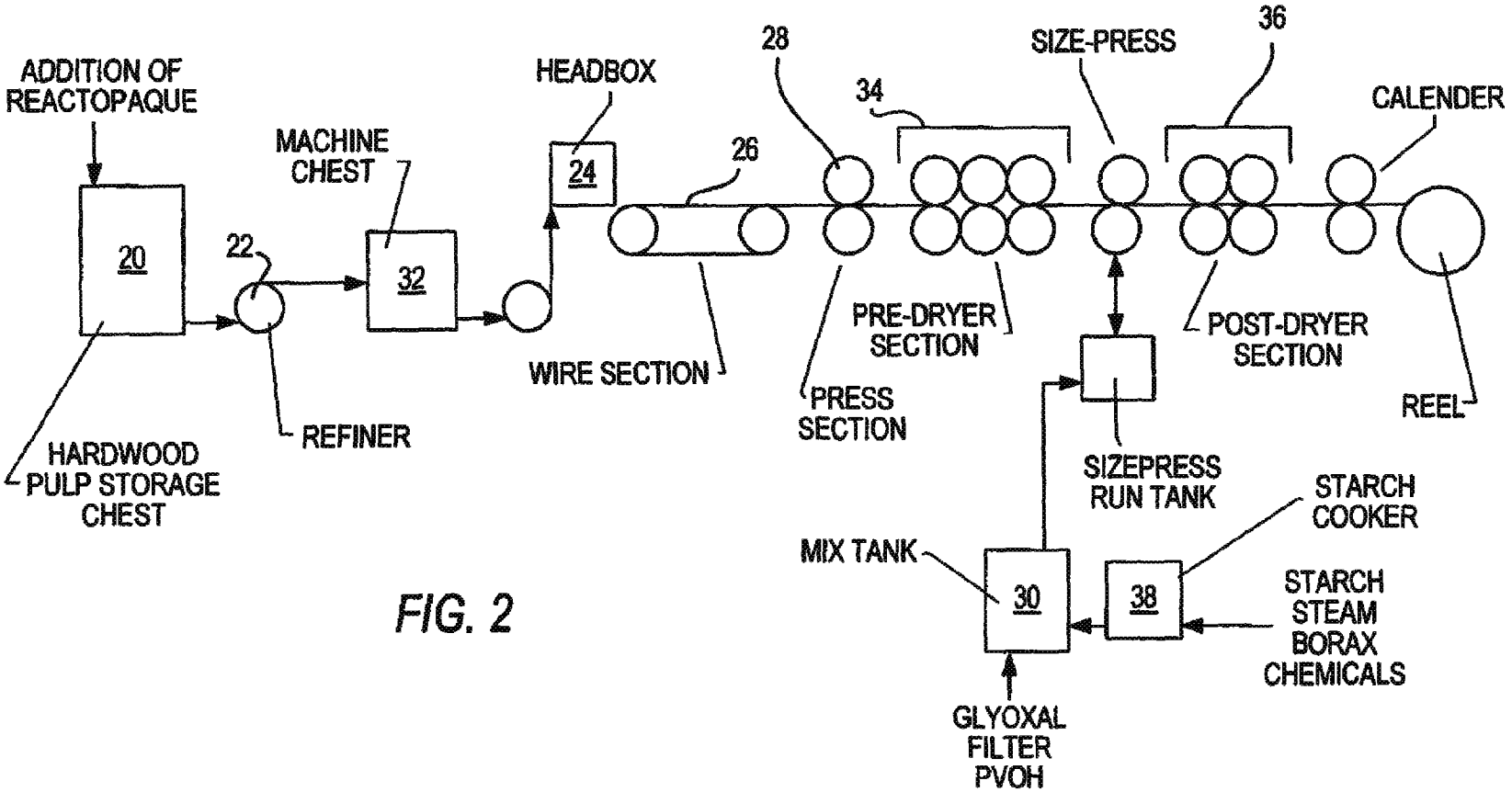
FIG. 2 is a schematic illustration of a paper machine process.

As completed, the basis weight of paper 10 is generally in the range of 59-410 g/m$^2$ and the coating has a basis weight between 2 and 10 g/m$^2$ FIG. 2 depicts a schematic that is one embodiment of a method used for formulating the paper of FIG. 1. Numerous types of papermaking machines are known, many with variants of a typical wet-end/dry end type machine. Thus, the present invention is not limited to a specific type of paper making machine such as the one represented in the schematic of FIG. 2.

A bulking agent 20 is added to a furnish during the wet-end of the paper making machine, wherein the furnish may further comprise additives including fillers, retention aids, surfactants, and other substances typically added to wet end paper furnished that are known in the art. In the present embodiment, the preferred hulking agent is a diamide salt based product (Reactopaque 100). However, other bulking agents may be used within the spirit of the invention.

The wet-end further comprises a refiner 22 for mechanical treatment of the pulp, a machine chest 32, a headbox 24 that discharges a wide jet of the furnish onto a wire section to form a fibrous paper web, a wire section 26 having a moving screen of extremely fine mesh, a press section 28, and a dryer section 34 comprising a plurality of support rolls that dries the fibrous web and conveys it to the size press.

A starch based coating is mixed in a mix-tank 30. The starch used is preferably a hydroxy ethylated starch, oxidized starch, cationically modified or enzymatically converted starch from any regularly used starch source, such as from potato, corn, wheat, rice or tapioca. In the present embodiment, starch is cooked and added to the mix-tank with viscosity modifiers, cross-linkers and fillers such as one or more of the following: polyvinyl alcohols, ammonium zirconium carbonate, borate chemicals, glyoxal, melamine formaldehyde, ground and precipitated calcium carbonates, clays, talc, $TiO_2$, and silica. The starch may be cooked with a borate chemical in a starch cooker 38 prior to entry into the mix-tank. The mixed coating is conveyed to a size press tank and then size pressed onto the paper web, coating one or both sides of the web. The starch based coating preferably has starch solids in the range of 6-20% by weight. The coating layers may be added simultaneously or in series in accordance with one of two techniques typically used in the industry. The paper's thickness, weight, stiffness and curl resistance are largely the same with either technique.

The size press-treatment used is preferably a metered size-press application. Due to the nature of the metered size press, application of starch solids can be controlled and normalized. As a result, penetration of the starch coating into the cellulosic core layer is minimal, maintaining the I-beam effect of the three-layer single ply structure. Even so, other size-presses known in the art, such as a flooded-nip size-press application, may be used. In this instance the potential for application of starch solutions to the outer layers is not the same as for metered size-press units due to inherent deeper penetration into the sheet in the flooded-nip.

The coated paper web is then conveyed to the size-press treatment in the dry end 36 of the paper making machine, wherein the dry end typically comprises a multiplicity of steam heated, rotating cylinders under a heat confining hood structure in proximity to the paper web traveling route to further dry the paper after size press application.

The resultant paper substrate exhibits one or more enhanced properties as compared to substrates that do not include the bulking additive and/or the high solids starch size-press in combination with viscosity modifiers and/or cross-linkers. For example, for some embodiments of this invention, the substrate exhibits improved Sheffield Smoothness (TAPPI 538om-88)) on both wire side and felt side of the substrate in contrast to the same substrate without the above mentioned ingredients, thus enabling less calendering with retained bulk.

Further, the paper exhibits improved curl resistance, a property of greatest importance for end-user performance of reprographic grades, improved hygroexpansivity, and enhanced Lorentzon & Wettre Bending Resistance. Other benefits of the invention include a more closed sheet and/or an enhanced possibility to target a certain porosity of the paper, resulting in higher Gurley numbers (TAPPI T460 om-96). This is beneficial as reprographic papers are usually fed through copier machines using vacuum suction to lift the sheets.

The following non-limiting examples illustrate various additional aspects of the invention. Unless otherwise indicated, temperatures are in degrees Celsius, paper basis weight is in grams per square meter and the percent of any pulp additive or moisture is based on the oven-dry weight of the total amount of material.

Example 1

A series or trials were made on a paper machine equipped with a flooded-nip size-press. Paper was made from a mixture of about 9 parts hardwood and 1 part softwood and containing 19% filler (precipitated calcium carbonate). A standard AKD size was added as internal size and a standard surface size was added to the size-press together with the starch solution. The trial commenced with addition of Reactopaque 100 to the hardwood pulp chest before refining. The addition rate was ramped up to 0.15% and the size-press coating having enzymatically converted corn starch was changed to contain starch at higher solids (10% instead of the standard 8%) in combination with 5 parts based on starch of glyoxal (Sequarez 755, Omnova Solutions Inc., SC, USA) and 25 parts based on starch of ground calcium carbonate, (Omyafil OG, Omya, Inc., Alpharetta, Ga., USA). One condition was run at these settings, then the size-press coating was switched back to starch without glyoxal and filler while maintaining the higher solids. The last condition maintained these settings but decreasing the paper basis weight in order to evaluate the impact of bending stiffness. Table 1 gives the results in Lorentzon & Wettre bending resistance (bending stiffness), paper caliper and Bendtsen porosity as compared to a control without a bulking agent and standard starch solids. Condition 2 shows an increase over the control in caliper and in bending stiffness and a decrease in the porosity number. Condition 2 also showed a smoother surface as determined from the Bendtsen smoothness number, which decreased from 225/210 ml/min (wire/felt side) to 205/195 ml/min (wire/felt side). This and the decreased porosity for condition 2 can be attributed to the filler closing the surface and creating a smoother surface. The most important finding is when comparing Condition 2, 3 and 4 with Condition 1 (control). The caliper increases with addition of Reactopaque and the bending stiffness goes up as a result of the increased caliper in combination with increased starch located in the surface layers. The overall starch content in the sheet also increased as a result of the more open sheet (higher Bendtsen porosity number). Condition 4 compared to Condition 1 is especially important as it shows that the increased bending stiffness allows for the basis weight to be decreased while maintaining almost the same stiffness as the control.

TABLE 1

| Condition | Treatment | Basis weight gram/m$^2$ | Caliper micron | Bending stiffness, mN MD/CD | Bendtsen porosity ml/min |
|---|---|---|---|---|---|
| 1 | Control | 80.3 | 99.4 | 104/62 | 880 |
| 2 | Reactopaque Increased starch solids with glyoxal and GCC | 80.3 | 102.3 | 117/57 | 715 |
| 3 | Reactopaque Increased starch solids | 79.8 | 102.5 | 121/55 | 980 |
| 4 | Reactopaque Increased starch solids Reduced basis weight | 78.3 | 100.1 | 107/58 | 1000 |

Example 2

A series of papers were evaluated in metered size-press trials. A test base paper was produced at 90 gram per square meter without Reactopaque 100. Control C1 using this base paper was given a size press coating of 2 g/m$^2$, control C2 was given a size press coating of 5 g/m$^2$, and control C3 was given a size press coating of 8 g/m$^2$. The controls were run in side-by-side comparisons on a metered size-press unit with a series of test papers produced with 88 gram per square meter with 0.18% Reactopaque 100 added before hardwood refining. The test base papers were given a size-press coating containing hydroxy ethylated corn starch (Ethylex 2035 from A. E. Staley Manufacturing Co., Decatur, Ill., USA) at higher solids (18% instead of the standard 8%) in combination with glyoxal and a filler (ground calcium carbonate). The size-pressed coated papers were tested fir bending stiffness, smoothness and porosity. In order to summarize the results, bending stiffness was plotted as a function of smoothness and results evaluated at a Sheffield smoothness of 120 after steel to steel calendering. Gurley porosity and Sheffield smoothness numbers are given for the un-calendared papers. The coefficient of hygroexpansion was evaluated on paper strips in machine and cross-machine direction using a Varidim hygroexpansivity tester (Techpap, Grenoble, France). Hygroexpansion was measured between 15 and 90% relative humidity from which the coefficient of hygroexpansion was calculated.

Different additives for the starch solutions were selected from the list below:

Sodium tetraborate pentahydrate, borax (Neobor from US Borax, Calif., USA) added in 0.25% on starch before the starch was cooked.

Glyoxal (Sequarez 755, Omnova Solutions Inc., SC, USA) added in 5% on starch in combination with precipitated calcium carbonate added in 50% based on starch (Megafil 2000, Specialty Minerals, Pa., USA)

Polyvinyl alcohol (Celvol 325 from Celenese Chemicals, TX, USA) added in 5% on starch.

Table 2 shows the results. The combination of high starch solids and viscosity modifier/filler/cross-linker increases bending stiffness by over 20% over the control. High starch solids alone also give some benefit but the surprising result is the overall impact on several important paper properties by the bulking and size-press application. The size-press application gives a more closed sheet as seen from the increasing Gurley porosity numbers, the base paper containing the hulking additive is smoother and the coefficient of hygroexpansion is significantly lower for the conditions with the combination of high starch solids and viscosity modifier/filler/cross-linker.

TABLE 2

| Condition | Treatment | Coat weight of size-press coating, gram per square meter | Bending stiffness mN, MD + CD | Percent stiffness increase relative to control | Porosity Gurley seconds | Smoothness Sheffield | Coefficient of hygroexpansion |
|---|---|---|---|---|---|---|---|
| C1 | Base paper 90 g/m$^2$ Starch 10% solids | 2 | 164 | 0% | 13 | | |
| C2 | Base paper 90 g/m$^2$ Starch 10% solids | 5 | 191 | 0% | 17 | 180 | 0.01 |
| C3 | Base paper 90 g/m$^2$ Starch 10% solids | 8 | 210 | 0% | 23 | | |
| 4 | Bulked base paper 88 g/m$^2$ Starch 18% solids | 2 | 185 | 13% compared to C1 | 30 | | |
| 5 | Bulked base paper 88 g/m$^2$ Starch 18% solids | 5 | 200 | 5% compared to C2 | 35 | | |
| 6 | Bulked base paper 88 g/m$^2$ Starch 18% solids | 8 | 215 | 2% compared to C3 | 34 | 148 | 0.01 |
| 7 | Bulked base paper 88 g/m$^2$ Starch 18% solids 0.25 parts of borax on starch added before starch cook | 2 | 193 | 18% compared to C1 | 34 | | |
| 8 | Bulked base paper 88 g/m$^2$ Starch 18% solids 0.25 parts of borax on starch added before starch cook | 5 | 216 | 13% compared to C2 | 35 | | |
| 9 | Bulked base paper 88 g/m$^2$ Starch 18% solids 0.25 parts of borax on starch added before starch cook | 8 | 223 | 6% compared to C3 | 34 | 157 | 0.009 |
| 10 | Bulked base paper 88 g/m$^2$ Starch 18% solids 5 parts glyoxal on starch and 25 parts PCC on starch added to starch coating | 2 | 200 | 22% compared to C1 | 30 | | |
| 11 | Bulked base paper 88 g/m$^2$ Starch 18% solids 5 parts glyoxal on | 5 | 212 | 11% compared to C2 | 32 | | |

TABLE 2-continued

| Condition | Treatment | Coat weight of size-press coating, gram per square meter | Bending stiffness mN, MD + CD | Percent stiffness increase relative to control | Porosity Gurley seconds | Smoothness Sheffield | Coefficient of hygroexpansion |
|---|---|---|---|---|---|---|---|
| | starch and 25 parts PCC on starch added to starch coating | | | | | | |
| 12 | Bulked base paper 88 g/m$^2$ Starch 18% solids 5 parts glyoxal on starch and 25 parts PCC on starch added to starch coating | 8 | 226 | 8% compared to C3 | 37 | 158 | 0.009 |
| 13 | Bulked base paper 88 g/m$^2$ Starch 18% solids 5 parts polyvinyl alcohol on starch added to starch coating | 2 | 192 | 17% compared to C1 | 31 | | |
| 14 | Bulked base paper 88 g/m$^2$ Starch 18% solids 5 parts polyvinyl alcohol on starch added to starch coating | 5 | 213 | 12% compared to C2 | 43 | | |
| 15 | Bulked base paper 88 g/m$^2$ Starch 18% solids 5 parts polyvinyl alcohol on starch added to starch coating | 8 | 222 | 6% compared to C3 | 52 | 160 | 0.009 |

Example 3

A series of papers were formed from a mixture of 8 parts Northern hardwood pulp and 2 parts Northern softwood pulp and having 20% filler, precipitated calcium carbonate (Megafil 2000) from Specialty Minerals. The pulps were refined together and having a Canadian Standard Freeness of about 450 ml. A standard AKD size (Hercon 70) from Hercules was added in the wet-end to give the base sheet a Hercules size test number of 50-100 seconds. Reactopaque 100 at 0.17 wt %) was added before refining at a temperature of the pulp of 54 C (130 F) to achieve the bulking effect. The papers were tested for heated curl with a proprietary instrument developed for such measurements at assignee's International Paper's research center. The results are given in Table 3. It is shown that the addition of Reactopaque 100 to the base sheet gives a significant reduction in the curl number (a difference in 5 units is considered to be a significant difference.)

TABLE 3

| Paper sample | Treatment | Heated curl, millimeter |
|---|---|---|
| 1 | 75 gram per square meter No Reactopaque 100 | 42 |
| 2 | 80 gram per square meter No Reactopaque 100 | 32 |
| 3 | 75 gram per square meter Reactopaque 100 added | 25 |
| 4 | 80 gram per square meter Reactopaque 100 added | 20 |

Although the invention has been described with reference to preferred embodiments, it will be appreciated by one of ordinary skill in the art that numerous modifications are possible in light of the above disclosure. For example, the optimum amount of bulking agent used with different types and ratios of cellulosic fibers may vary. All such variations and modifications are intended to be within the scope and spirit of the invention as defined in the claims appended hereto.

I claim:

1. A paper or paperboard having improved bulk and stiffness comprising: a three layered single-ply I-beam structure having a higher density strengthened top layer, a lower density bulked central layer and a higher density strengthened bottom layer, wherein the central layer is a cellulosic core layer, and the top and bottom layers are strengthening starch based, size-press applied coating layers that cover an upper and lower surface of the central layer with minimal penetration into the central layer such that starch is substantially absent from the central layer, and a bulking agent interpenetrated within the central layer, and wherein the top and bottom layers are formed are from a high strength starch based size-press solution having from about 6 to about 12 wt % starch solids.

2. The paper or paperboard of claim 1, wherein the ratio of the thickness of the top layer and the bottom layer compared to the thickness of the paper or paperboard is between 1:50 and 1:1.1.

3. The paper or paperboard of claim 1, wherein the basis weight of the paper is between 59 g/m$^2$ and 410 g/m$^2$ and the basis weight of each of the top and bottom coating layers are between 2 and 10 g/m$^2$.

4. The paper or paperboards of claim 1, wherein the top and bottom layers have starch application controlled with a metered size press.

5. The paper or paperboard of claim 1, wherein the bulking agent is diamide salt based product.

6. The paper or paperboard of claim 1, wherein the bulking agent is made from a polymeric material in form of microspheres selected from the group consisting of methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more or the foregoing.

7. The paper or paperboard of claim 6, wherein the central layer further comprises a retention agent.

8. The paper or paperboard of claim 1, wherein the central layer further comprises an additive selected from the group consisting of fillers, surfactants, sizing agents, or a combination thereof.

9. The paper or paperboard of claim 1, wherein the starch is selected from the group consisting of hydroxy ethylated starch, oxidized starch, cationically modified or enzymatically converted starch from any regularly used starch source, such as from potato, corn, wheat, rice or tapioca.

10. The paper or paperboard of claim 1, wherein the top and bottom layers further comprise a cross linking agent.

11. The paper or paperboard of claim 1, wherein the top and bottom layers further comprise a viscosity modifier.

12. The paper or paperboards of claim 1, wherein the top and bottom layers further comprise a pigment.

13. The paper or paperboard of claim 1, further comprising additives selected from the group consisting of polyvinyl alcohols, ammonium zirconium carbonate, borate chemicals, glyoxal, melamine formaldehyde, ground and precipitated calcium carbonates, clays, talc, $TiO_2$, and silica, or a combination thereof.

14. The paper or paperboard of claim 1, wherein starch coat weights of each of the top and bottom coating layers are between 2 and 10 $g/m^2$.

15. A method for making a paper or paperboard comprising the steps of: a) providing a furnish including cellulosic fibers and a bulking agent, b) forming a fibrous web from the papermaking furnish, c) drying the fibrous web to form a dried web, d) size-press treating the dried web with a high strength starch based size-press solution having from about 6 to about 12 wt % starch solids to form top and bottom coating layers on a top and bottom side of the dried web, and e) drying the size-press treated web to form a three layered single-ply having an I-beam structure comprising a higher density strengthened top layer, a lower density bulked central layer and a higher density strengthened bottom layer, and wherein starch is substantially absent from the central layer.

16. The method of claim 15, wherein the ratio of the thickness of the top and bottom coating layers compared to the thickness of the paper or paperboard is between 1:50 and 1:1.1.

17. The method of claim 16, wherein a starch solution of the high strength starch based size-press solution is precooked with a borate chemical prior to the size-press treatment.

18. The method of claim 15, wherein the basis weight of the paper is between 59 gsm and 410 gsm and the basis weight of each of the top and bottom coating layers are between 2 and 10 gsm.

19. The method of claim 15, wherein the size-press treatment uses a metered size-press.

20. The method of claim 15, wherein the bulking agent is a diamide salt based product.

21. The method of claim 15, wherein the furnish further contains an additive selected from the group consisting of: fillers, surfactants, or a combination thereof.

22. The method of claim 16, wherein the starch is chosen from a group comprising of: hydroxy ethylated starch, oxidized starch, cationically modified or enzymatically converted starch from any regularly used starch source, such as from potato, corn, wheat, rice or tapioca.

23. The method of claim 15, wherein the size-press solution further contains an additive selected from the group consisting of: polyvinyl alcohols, ammonium zirconium carbonate, borate chemicals, glyoxal, melamine formaldehyde, ground and precipitated calcium carbonates, clays, talc, $TiO_2$, and silica, or a combination thereof.

* * * * *